United States Patent [19]

Alsip

[11] 4,234,185

[45] Nov. 18, 1980

[54] STRATEGY AND PERCEPTION GAME

[76] Inventor: Bruce F. Alsip, 270 Almak Ct. N.W., Issaquah, Wash. 98027

[21] Appl. No.: 913,572

[22] Filed: Jun. 8, 1978

[51] Int. Cl.[3] ..... A63F 3/00; A63F 9/00

[52] U.S. Cl. ..... 273/243; 273/284

[58] Field of Search ..... 273/243, 242, 264, 271, 273/281, 282, 284, 287

[56] References Cited

U.S. PATENT DOCUMENTS

| | | | |
|---|---|---|---|
| 1,092,599 | 4/1914 | Schilling | 273/284 |
| 1,525,417 | 3/1925 | Steinberg | 273/260 X |
| 2,215,936 | 9/1940 | Robertson | 273/284 |
| 3,705,727 | 12/1972 | Breslow | 273/271 |
| 3,709,497 | 1/1973 | Barlow | 273/282 X |
| 3,731,934 | 5/1973 | Shoptaugh | 273/284 X |
| 3,762,714 | 10/1973 | Wilson | 273/248 |
| 3,794,326 | 2/1974 | Bialek | 273/255 |
| 3,804,418 | 4/1974 | Sander | 273/260 |

FOREIGN PATENT DOCUMENTS

| | | | |
|---|---|---|---|
| 1072945 | 6/1967 | United Kingdom | 273/260 |

*Primary Examiner*—Richard C. Pinkham
*Assistant Examiner*—Scott L. Brown
*Attorney, Agent, or Firm*—Cole, Jensen & Puntigam

[57] ABSTRACT

A game involving strategy, perception and decision making wherein the board comprises a base member having a plurality of horizontally slidable members having a plurality of uniformly spaced marker receiving positions. Each player has a definitive number of markers and each turn is initiated by a roll of a pair of dice or other random selection means. Upon the completion of a roll or turn, a player will place a marker upon any one of the slides in a receiving position corresponding to indicia shown upon his side of the board. A score is tabulated at the end of a turn by counting the number of markers belonging to the scoring player in a line either perpendicular to the direction of slide movement or diagonally across the board. One of the "slides" may be fixed to establish a stable base for building scores but will still be a part of the scoring procedure.

1 Claim, 3 Drawing Figures

FIG. 1
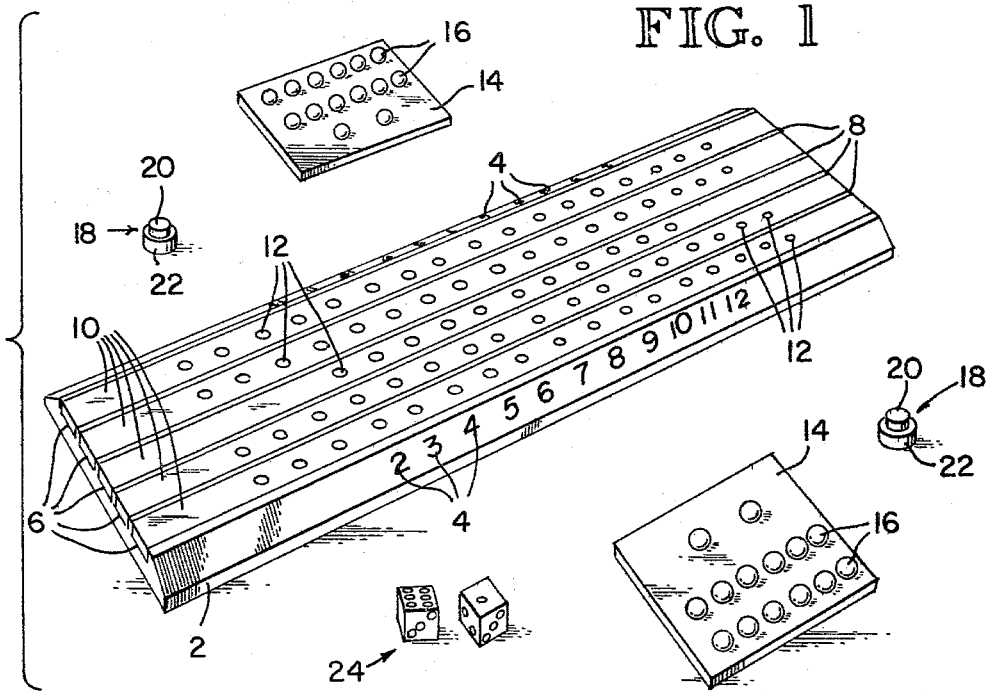
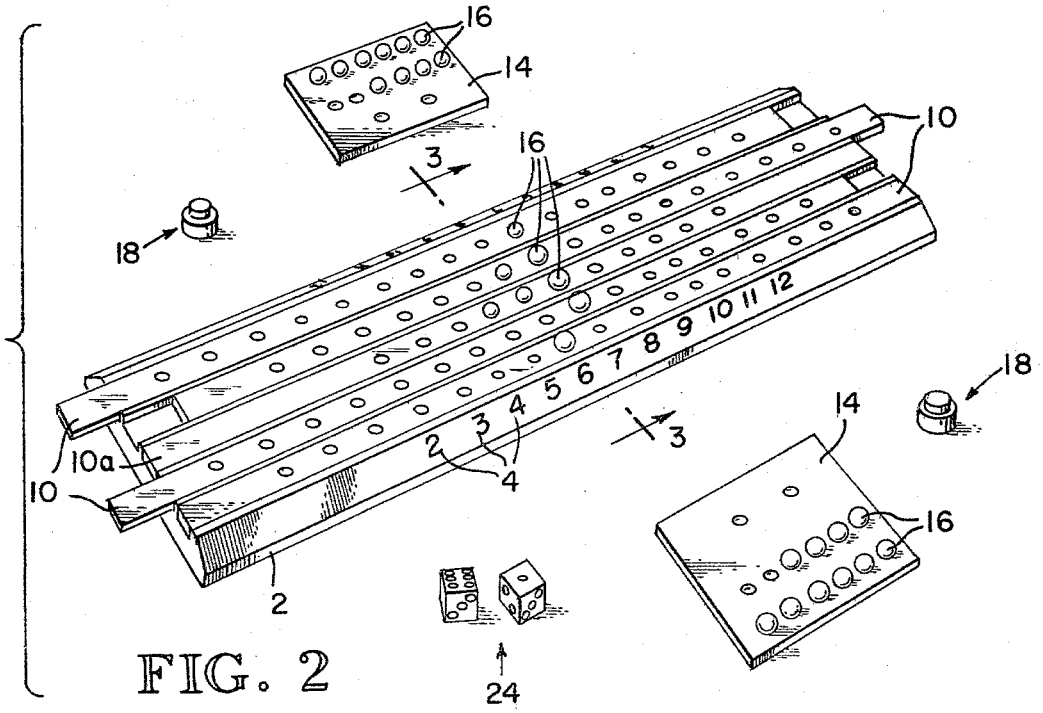
FIG. 2
FIG. 3
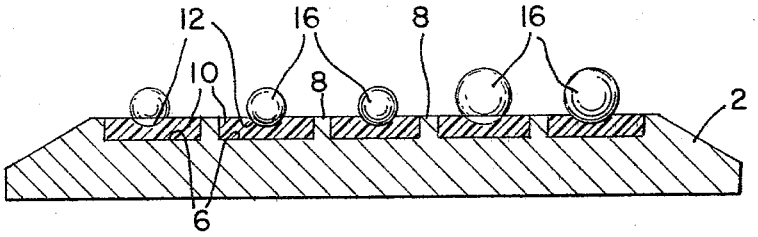

STRATEGY AND PERCEPTION GAME

BACKGROUND OF THE INVENTION

The present game is designed to entertain, provide amusement and educational stimulation for both adults and children. The game improves numerical skills as well as developing hand-eye coordination and manipulative ability. The game has a sufficient element of chance coupled with an element of strategy whereby the game can be played and enjoyed by opponents of widely varying ages and/or ability.

In the basic form, the game comprises a playing board which is designed to have a plurality of essentially parallel slides mounted to the upper portion thereof. An individual player will move a single slide during his turn to capitalize upon the scoring strategy. In short, the game allows a player to place markers upon the board following a throw of the dice or the use of some other random selector. During each turn, a player places a marker at a prechosen strategic position such that he can move a slide to either increase his particular score or attempt to disrupt his opponents strategy, thus reducing his score. Since the players alternate in taking turns, the chance portion becomes predominate.

The prior art known to the inventor includes U.S. Pat. No. 3,229,388 granted Jan. 18, 1956 to Smith. This patent deals with an educational device including, in particular, a set of blocks having numberical indicia. The goal of the game is to build upon a basic block unit wherein the variable to be observed is one of length which corresponds to multiples of the unit.

Another patent known to the inventor is that granted to Stone on Sept. 1, 1970 and bearing the U.S. Pat. No. 3,526,045 which deals with a segmented movable number line including a plurality of counters, each independently slidably mounted on a frame, and including a number marking on each one of the counters. The numbers on adjacent counters form a progressive number series. The combination of the various elements results in a calculator usable by children in teaching numerical concepts.

U.S. Pat. No. 3,788,644 granted to Evans on Jan. 29, 1974 includes a board apparatus for playing a mathematical game and the board includes apertures adapted to receive the stem of a marker. The player utilizes dice to determine the number of markers encompassed with each move and the game encourages success in developing mathematical abilities.

U.S. Pat. No. 3,808,708 granted to Huskin on May 7, 1974 deals with a playing board having a number of parallel rows of cubicles. Each of the cubes have on their face problems in multiplication or division and on the opposite face answers to those problems. Sliding board pieces contain answers to the problems enabling the player to check his solutions and other sliding pieces contain indicia representative of fractions or elementary slide rule markings to teach their basic operations.

With the above noted prior art in mind, it is an object of the present invention to provide a game combining chance and strategy both from the offense and defense position which is attractive to players within a large span of age groups or abilities.

It is another object of the present invention to provide a game wherein the players will use a definitive preconceived approach to capitalize upon scoring and thus win a game, however, the rolling of the dice or other random selection device incorporates a sufficient element of chance to preclude the complete domination by one player or strategy.

Yet another object of the present invention is to provide a game wherein the hand/eye coordination and/or manipulative skills of the player are enhanced.

Still a further object of the present invention is to provide a game which, although teaching basic skills, involves a sufficient amount of chance and strategy that players of dissimilar ages and/or intelligence can compete effectively.

BRIEF DESCRIPTION OF THE DRAWINGS

FIG. 1 is a pictorial representation of the inventive game including the base element including a plurality of slides as well as supporting or home base platforms for the playing elements.

FIG. 2 is a similar representation of FIG. 1 depicting the game in a possible configuration during the game.

FIG. 3 is an elevational view taken along line 3—3 of FIG. 2.

DETAILED DESCRIPTION OF THE DRAWINGS

As seen in FIG. 1, the inventive game includes a base member 2 of generally rectangular outline having a plurality of numerical indicia located upon opposite sides of the board such that opposing contestants most easily see and utilize the indicia which reads from the left to the right. The indicia would thus read in opposite directions on either side. The board has a plurality of parallel grooves or slots 6 each separated by a raised portion 8 and each receiving a slide 10.

In the broad concept, it is to be understood that one or more of the portions denoted slides 10 in the figures could, in fact, be fixed or a permanent portion of the board to alter the playing strategy of the game.

In the preferred embodiment, the centermost slide, which has fewer marker receiving positions, remains stationary during the game permitting a player to build a foundation for future moves. Each one of the slides 10 includes a plurality of bores or recesses 12 each of which is designed to accept or receive a playing piece or marker during the progress of the game.

It is to be noted that each of the slides, whether they be fixed or movable, includes at a minimum the number of bores or recesses equal to the number of integers or indicia marked along the side of the playing board itself. For convenience, and in the preferred embodiment, each player has a home or storage board 14 wherein the particular playing pieces are located prior to the commencement of and during the progress of the game.

In the preferred embodiment, the playing pieces are a plurality of steel bearings or balls 16 of differing sizes for each player to distinguish the markers for scoring purposes and, as explained hereinafter with respect to the playing rules, a magnet element 18. Magnet element 18, includes a magnet 20 and a supporting base or holder 22, is provided for removal of the playing elements from the board during a game in accordance with the directions outlined hereinafter. Further, as explained hereinafter, a pair of dice 24 are provided to determine the order of play and further to determine the particular placement of a marker and thus the move for each player during the game. It is to be understood that the dice are used to introduce a random possibility to the game.

As seen in FIG. 2, and as further explained hereinafter, the various portions or elements of the game are identical to those shown in FIG. 1 and therefore bear the same identifying numbers. The game, however, is depicted in a typical configuration while the game is in progress. It is to be noted that some of the slides have been moved to the left and some of the slides have been moved to the right from their original neutral position as depicted in FIG. 1 and as will be more definitively explained with respect to the rules. It is to be noted that the center slide 10*a* has been purposely left in its initial starting position since although it is an intimate portion of the game and of the scoring, it provides one stable unchangeable basis for strategy and for scoring.

As seen in FIG. 3, the base member 2 is shown of a truncated pyramidal configuration in cross-section but is not limited to such a configuration. The base member must provide a support for a plurality of parallel slide elements 10, which, as shown are particular configured with game piece receiving portions 12 and fitted within grooves 6 defined by upstanding elements 8 in addition to providing a surface for the necessary indicia. The board may be of any desired configuration or size as long as it provides the necessary base and support for the game. The particular playing pieces 16 are shown in different sizes for each player but it is to be understood that the particular markers in terms of shape, color and/or size are not critical as long as one player's markers may be quickly distinguished from the opposing player's markers.

For purpose of defining playing technique, the illustrative or preferred embodiment will be utilized. As can be seen, each player has 14 playing pieces or markers which may be easily contained in a home position or player support board. It is to be understood that the number of pieces shown is illustrative only and may be varied to alter game technique. To initiate play, each player rolls the dice or initiates some other random selector and determines by the throw of the dice which player will begin playing.

Following the determination of the first player, that individual again throws the dice or initiates the random sampler and thus determines at which position upon any one of the slides he may place a marker. He places one of his markers upon a slide in a position corresponding to the indicia on his side of the board or otherwise designated as his.

In the preferred embodiment, the center "slide" is, fixed and once a marker is placed on the centerslide, the marker cannot be removed, as elaborated upon hereinafter.

If the particular player throwing the dice decides to place his marker on a slide other than one that has been designated fixed, he must then, following the placement of his marker, move the slide upon which he has placed a marker, a distance corresponding to one unit or mark. Each player in turn then places his markers upon the board and with the exception of those slides designated as fixed, move the slide the distance equal to one position.

A player has the option of placing his marker in a position occupied by an opponents marker and thus removing his opponents marker to place it back upon its home base or storage position to be played again or in the alternate, remove it from the game. It is to be noted that the indicia or integers upon the base element remain constant and thus the corresponding receptacle or marker receiving position on a given slide may well change from turn to turn.

As noted above, the markers placed upon a fixed "slide" may not be removed.

An individual player scores after each turn and a score is based upon the number of his own markers which are adjacent and linear in a position either perpendicular to the motion of the slides or on a diagonal thereto. A score is not made by placing markers in positions parallel to the movement of the slides.

Thus a player by rolling a particular set of numbers upon the dice or having a number determined by other random means, will determine the position of the next placement of his marker and can by judicial placement of that marker and movement of the slide upon which he has placed the marker multiply his particular score for that turn or alternatively prevent or limit the amount of score achieved by his opponent during his next turn.

The game will be ended when one of the players has exhausted all of his available markers and the scoring may well reflect a bonus or a penalty for being the first to place all of the markers.

Thus as can be seen, the game involves an element of chance i.e. the particular position of a marker determined by a roll of the dice and further involves a very strong element of strategy in that the particular placement of the marker and movement of the slide not only determines the scoring for a player at that particular time but also can easily serve as a deterent to a score for the opponent.

It is to be understood that the description hereinabove is the preferred and most simple embodiment and that the game may be used either in the form as described or alternatively may be used in tandem including a plurality of boards used by a team of opposing players or alternatively, may be used by a group of opposing players playing individual games. The number of players, marker, slides or the configuration of the board will alter the specific playing but will not alter the basic concept.

What is claimed is:

1. A game of skill and chance comprising:

a plurality of markers for each player, a game board having discrete indicia means along the edges thereof and including a plurality of parallel elongated slides mounted upon the board for movement along their length, each of said slides having a row of discrete marker receiving positions corresponding to the discrete indicia means along the line of movement of said slide, said slides being limited in movement only by the fact that during play at least one of the marker receiving positions must be adjacent one of the indicia means, said game board further including at least one stationary line of discrete marker receiving positions, random selection means having indicia corresponding to the indicia on the board such that each player in turn places a marker at a marker receiving position corresponding to the indicia on the random selection means and moves a slide upon which the marker has been placed one position in either direction and tallies the score by counting adjacent markers.

* * * * *